US009726026B2

(12) United States Patent
Basirico et al.

(10) Patent No.: US 9,726,026 B2
(45) Date of Patent: Aug. 8, 2017

(54) TURBINE ROTOR AND BLADE ASSEMBLY WITH MULTI-PIECE LOCKING BLADE

(71) Applicant: General Electric Company, Schenectady, NY (US)

(72) Inventors: John Thomas Basirico, Albany, NY (US); Timothy Scott McMurray, Rotterdam Junction, NY (US); Laurence Scott Duclos, Thorndike, ME (US); Robert James Bracken, Niskayuna, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 503 days.

(21) Appl. No.: 13/965,244

(22) Filed: Aug. 13, 2013

(65) Prior Publication Data

US 2013/0330195 A1 Dec. 12, 2013

Related U.S. Application Data

(63) Continuation-in-part of application No. 13/489,502, filed on Jun. 6, 2012, now Pat. No. 9,212,563.

(51) Int. Cl.
*F01D 5/32* (2006.01)

(52) U.S. Cl.
CPC ..... *F01D 5/326* (2013.01); *F01D 5/32* (2013.01); *Y10T 29/49321* (2015.01)

(58) Field of Classification Search
CPC ..... F01D 5/303; F01D 5/3038; F01D 5/32; F01D 5/326; Y10T 29/49321
See application file for complete search history.

(56) References Cited

U.S. PATENT DOCUMENTS

| | | | | |
|---|---|---|---|---|
| 1,705,585 | A * | 3/1929 | Ray | F01D 5/3038 416/216 |
| 5,152,669 | A * | 10/1992 | Heinig | F01D 5/3007 29/889.21 |
| 6,419,447 | B1 | 7/2002 | Watanabe et al. | |
| 7,435,055 | B2 * | 10/2008 | Hansen | F01D 5/3038 416/215 |
| 7,901,187 | B2 | 3/2011 | Barber | |
| 2006/0245927 | A1 | 11/2006 | Yehle et al. | |
| 2007/0048130 | A1 | 3/2007 | Sullivan et al. | |
| 2007/0248464 | A1 | 10/2007 | Caruso et al. | |
| 2009/0047128 | A1 | 2/2009 | Bracken et al. | |
| 2010/0278652 | A1 | 11/2010 | Vitrone et al. | |

(Continued)

FOREIGN PATENT DOCUMENTS

| | | | | |
|---|---|---|---|---|
| DE | WO 2013026735 A1 * | 2/2013 | ..... | F01D 5/3038 |
| GB | 704882 A * | 3/1954 | ..... | F01D 5/3038 |

*Primary Examiner* — Kenneth Bomberg
*Assistant Examiner* — Jesse Prager
(74) *Attorney, Agent, or Firm* — Eversheds Sutherland (US) LLP

(57) ABSTRACT

The present application provides a turbine rotor and blade assembly for a steam turbine. The turbine rotor and blade assembly may include a rotor, a number of buckets positioned about the rotor and a locking blade positioned about the rotor. The locking blade may include a base, a first side hook, and a second side hook. The locking blade may include a first side pilot hole defined between the base and the first side hook and a second side pilot hole defined between the base and the second side hook.

19 Claims, 3 Drawing Sheets

(56) References Cited

U.S. PATENT DOCUMENTS

| | | | | |
|---|---|---|---|---|
| 2011/0110782 | A1* | 5/2011 | Brittingham | F01D 5/3038 416/215 |
| 2011/0154631 | A1 | 6/2011 | DeMania et al. | |
| 2011/0158814 | A1 | 6/2011 | Metri et al. | |
| 2011/0158815 | A1 | 6/2011 | Mandali et al. | |
| 2011/0163505 | A1 | 7/2011 | Bhagavatheeswaran et al. | |
| 2011/0255978 | A1* | 10/2011 | Potter | F01D 5/3038 416/204 A |
| 2012/0034086 | A1 | 2/2012 | Mishrikotkar et al. | |
| 2013/0177429 | A1* | 7/2013 | Bommanakatte | F01D 5/3007 416/220 R |
| 2013/0330204 | A1 | 12/2013 | Farineau et al. | |
| 2014/0234111 | A1* | 8/2014 | Dungs | F01D 5/3038 416/220 R |

* cited by examiner

Fig. 3
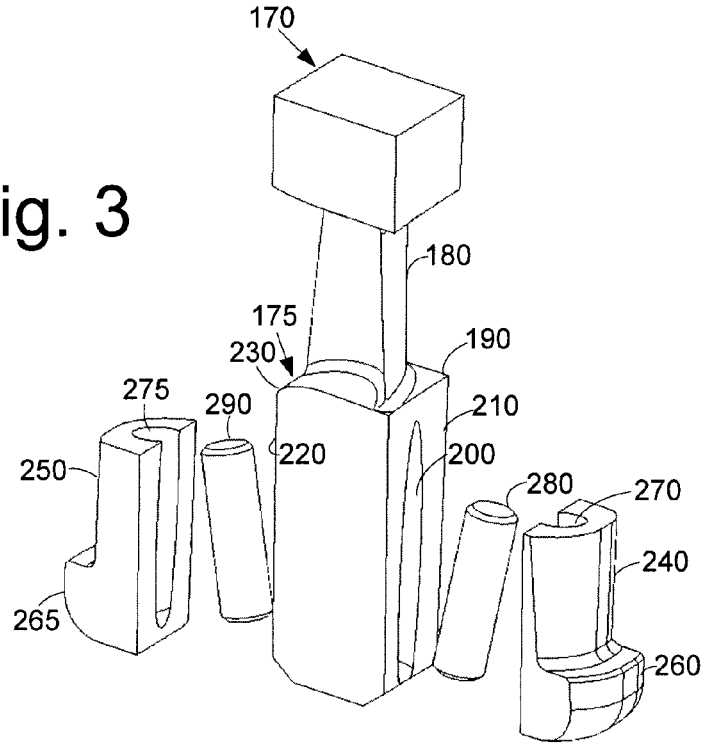
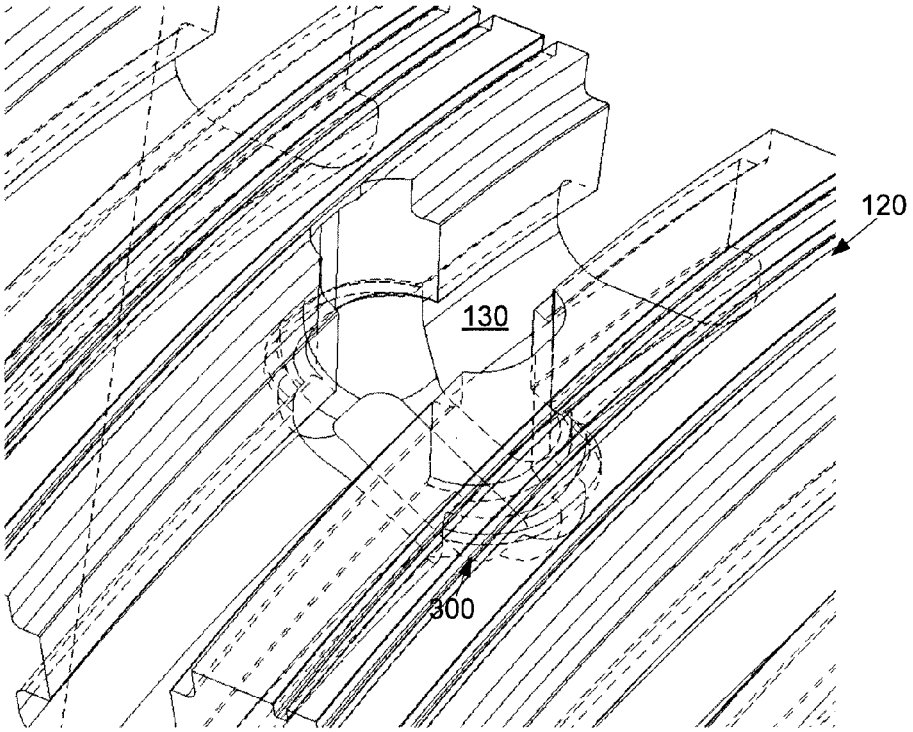
Fig. 4

TURBINE ROTOR AND BLADE ASSEMBLY WITH MULTI-PIECE LOCKING BLADE

RELATED APPLICATIONS

The present application is a continuation-in-part of U.S. Ser. No. 13/489,502, filed on Jun. 6, 2012, now pending. U.S. Ser. No. 13/489,502 is incorporated herein by reference in full.

TECHNICAL FIELD

The present application and the resultant patent relate generally to turbo-machinery and more particularly relate to a turbine rotor and blade assembly for use with a steam turbine having a multi-piece locking blade for reduced stress concentrations therein.

BACKGROUND OF THE INVENTION

Steam turbine airfoils or buckets generally are positioned about a rotor at regular intervals in a bucket assembly. The bucket assembly may be created by inserting the buckets one at a time tangentially into an opening on the rotor and then sliding the buckets circumferentially about the rotor. The buckets may be attached to the rotor by complementary male and female dovetails and other configurations. In order to close the bucket assembly, however, the last bucket must be restrained by a feature other than a dovetail. This last bucket, generally called the locking blade or the closure bucket, may be affixed to the rotor via one or more blade retention screws and the like tapped or screwed into the rotor. Other types of connection means and other types of bucket assemblies also may be used.

Large centrifugal loads may be placed on the buckets and the rotor during operation. Such centrifugal loads and coincident thermally induced loads associated with loading transients may induce stresses in the dovetails and adjacent areas that attach the buckets to the rotor. These stresses may be of sufficient magnitude to impact adversely rotor cycle fatigue life. Of particular concern may be rotor stress concentrations associated with blade retention screws that may be tapped or otherwise inserted directly into the rotor.

There is thus a desire for an improved turbine rotor and blade assembly for a steam turbine and the like. Preferably such an improved turbine rotor and blade assembly may reduce stress concentrations therein for an improved overall rotor fatigue life.

SUMMARY OF THE INVENTION

The present application and the resultant patent thus provide a turbine rotor and blade assembly for a steam turbine. The turbine rotor and blade assembly may include a rotor, a number of buckets positioned about the rotor, and a locking blade positioned about the rotor. The locking blade may include a base, a first side hook, and a second side hook. The locking blade may include a first side pilot hole defined between the base and the first side hook and a second side pilot hole defined between the base and the second side hook.

The present application and the resultant patent further provide a method of assembling a number of buckets on a rotor. The method may include the steps of positioning the buckets within a dovetail slot of the rotor, positioning a first side locking blade hook and a second side locking blade hook within a locking blade groove of the rotor, positioning a locking blade base between the first side locking blade hook and the second side locking blade hook, positioning a first side screw in a first side pilot hole formed between the first side locking blade hook and the locking blade base, and positioning a second side screw in a second side pilot hole formed between the second side locking blade hook and the looking blade base.

The present application and the resultant patent further provide a locking blade for use with a rotor. The locking blade may include a base, a first side hook, a first side pilot hole defined between the base and the first side hook, a second side hook, and a second side pilot hole defined between the base and the second side hook. The first side pilot hole and the second side pilot hole may include an angle extending towards the base.

These and other features and improvements of the present application and the resultant patent will become apparent to one of ordinary skill in the art upon review of the following detailed description when taken in conjunction with the several drawings and the appended claims.

BRIEF DESCRIPTION OF THE DRAWINGS

FIG. 3 is an exploded view of a locking blade for use with the turbine rotor and blade assembly of FIG. 2.

FIG. 4 is a partial transparent view of a rotor for use with the turbine rotor and blade assembly of FIG. 2.

DETAILED DESCRIPTION

Figure 1:
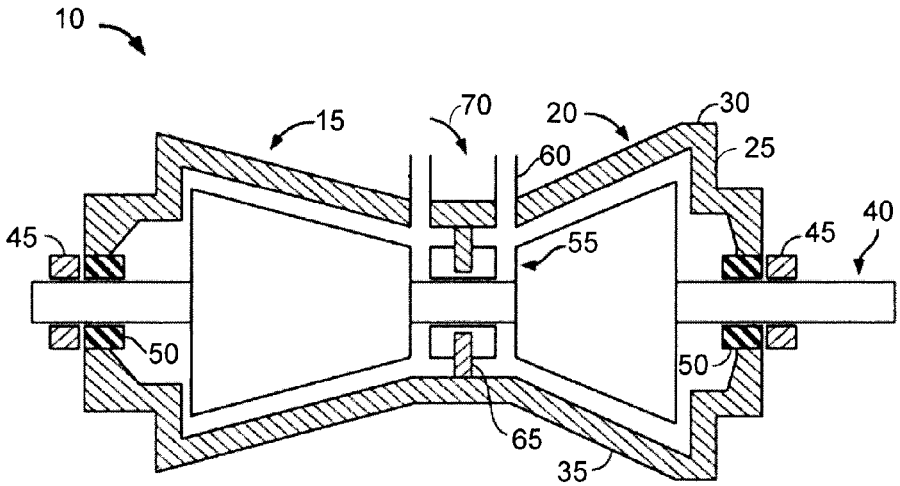
FIG. 1 is a schematic diagram of an example of a steam turbine with a number of sections.

Referring now to the drawings, in which like numerals refer to like elements throughout the several views, FIG. 1 is a schematic diagram of an example of a steam turbine 10 as may be used herein. The steam turbine 10 may include a first section 15 and a second section 20. The sections 15, 20 may be high pressure sections, intermediate pressure sections, and/or low pressure sections. Each of the sections 15, 20 may have a number of stages therein. An outer shell or casing 25 may be divided axially into upper and lower half sections 30, 35, respectively. A rotor shaft 40 may extend through the casing 25 and may be supported by a number of journal bearings 45. A number of seals 50 also may surround the rotor shaft 40 about the ends and elsewhere. A central section 55 may include one or more steam inlets 60. A flow splitter 65 may extend between the sections 15, 20.

In use, a flow of steam 70 passes through the steam inlets 60 and into the sections 15, 20 such that mechanical work may be extracted from the steam by the stages therein so as to rotate the rotor shaft 40. The flow of steam 70 then may exit the sections 15, 20 for further processing and the like. The steam turbine 10 described herein is for the purpose of example only. Steam turbines and/or other types of turbo-machinery in many other configurations and with many other or different components also may be used herein.

Figure 2:
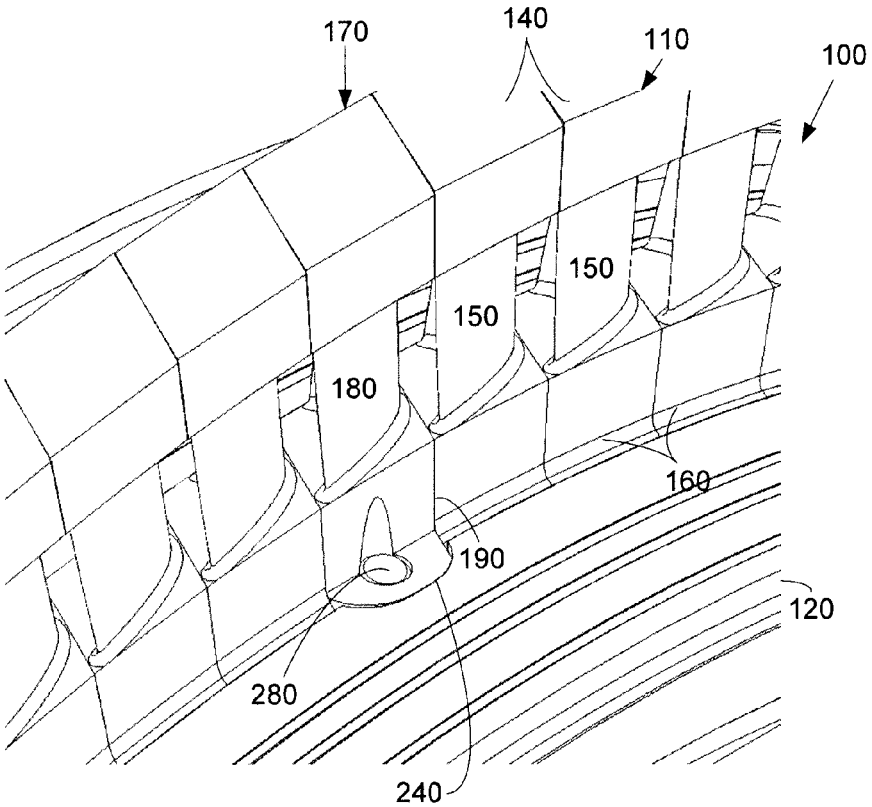
FIG. 2 is a partial perspective view of a turbine rotor and blade assembly as may be described herein.

FIG. 2 shows a portion of a steam turbine 100 as may be described herein. Specifically, the steam turbine 100 may include a turbine rotor and blade assembly 110. The turbine rotor and blade assembly 110 includes a turbine rotor 120.

The turbine rotor 120 includes a dovetail slot 130 formed therein. A number of buckets 140 may be mounted on the rotor 120 via tangential entry and the like. Each of the buckets 140 may include a blade 150 and a dovetail 160. The dovetail 160 may be configured to mate with the conforming dovetail slot 130 (or vice versa) of the rotor 120. The rotor 120 and the buckets 140 may have any size, shape, or configuration. Other components and other configurations may be used herein.

As is shown in FIG. 2 and FIG. 3, the turbine rotor and blade assembly 100 also may include a locking blade 170. As described above, the locking blade 170 may lack the dovetail 160. Rather, the locking blade 170 may have a multi-piece configuration 175. Specifically, the locking blade 170 may include a blade 180 extending from a base 190. The size, shape, and configuration of the base 190 may vary. The base 190 may have a first side base screw thread 200 on a first side 210 and a second side base screw thread 220 on a second side 230. The base 190 may be surrounded, in whole or in part, by a pair of hooks with a first side hook 240 on the first side 210 of the base 190 and a second side hook 250 on the second side 230 of the base 190. Each hook 240, 250 may have an outwardly extending flange, a first flange 260 and a second flange 265. The size, shape, and configuration of the hooks 240, 250 and the flanges 260, 265 may vary. Each of the hooks 240, 250 also may include a hook screw thread thereon, a first hook screw thread 270 and a second hook screw thread 275. A pair of screws such as a first side screw 280 and a second side screw 290 may be used to attach the hooks 240, 250 to the base 190. Other components and other configurations may be used herein.

As is shown in FIG. 4, the rotor and blade assembly 100 also may include a locking blade groove 300 positioned within the dovetail slot 130 of the rotor 120. The locking blade groove 300 may be sized to accommodate the base 190 and the hooks 240, 250 of the locking blade 170. Specifically, the locking blade groove 300 may be sized to accommodate the flanges 260, 265 on both of the hooks 240, 250. Other components and other configurations may be used herein.

In use, the buckets 140 of the rotor and blade assembly 110 may be positioned about the rotor 120 within the dovetail slot 130 as is described above. When all of the buckets 140 have been positioned thereon, the locking blade 170 may be inserted. Specifically, the hooks 240, 250 may be inserted within the locking blade groove 300 in the rotor 120. The base 190 then may be inserted between the hooks 240, 250. The base 190 then may be secured by inserting the side screws 280, 290 between the base screw threads 200, 220 and the hook screw threads 270. The rotor and blade assembly 100 thus may be secure. The rotor and blade assembly 110 also may be disassembled in reverse order.

The locking blade 170 with the multi-piece configuration 175 thus may improve the overall fatigue life of the turbine rotor blade assembly 110. Specifically, the use of the multi-piece configuration 175 may avoid inherent rotor stress concentrations that may be caused by the small radius of a tapped hole when using blade retention screws and the like. Rather, the multi-piece configuration 175 uses the hooks 240, 250 within the locking blade groove 300 of the rotor 120 without requiring the use of screws tapped or otherwise inserted into the rotor 120. The multi-piece configuration 175 thus may improve the fatigue life of the rotor 120 and related components for an extended component lifetime.

Figure 5:
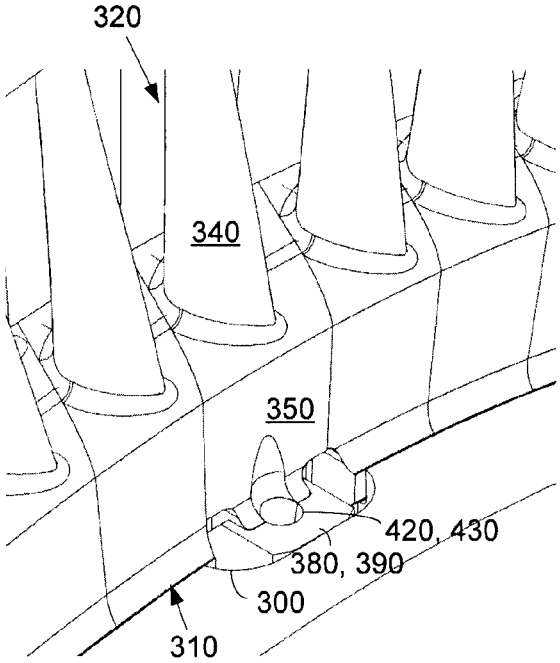
FIG. 5 is a top plan view of an alternative embodiment of a turbine rotor and blade assembly as may be described herein.
Figure 6:
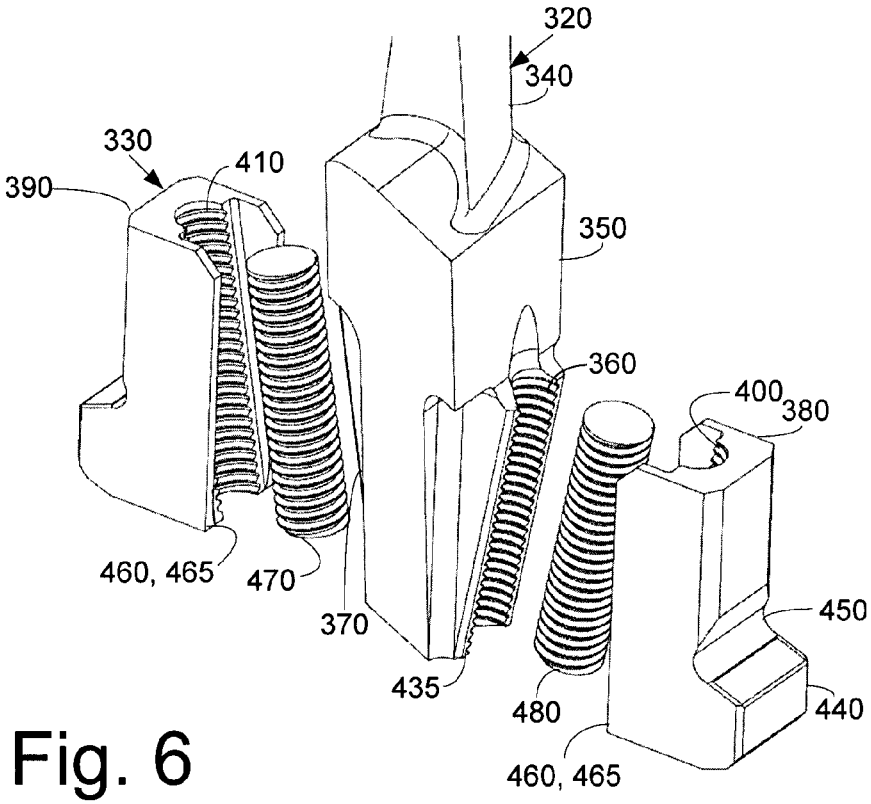
FIG. 6 is an exploded view of a locking blade as may be used with the turbine rotor and blade assembly of FIG. 5.

FIG. 5 and FIG. 6 show an alternative embodiment of a turbine rotor and blade assembly 310. The turbine rotor and blade assembly 310 may be used with the turbine rotor 120 with the dovetail slot 130 formed therein. As above, a number of the buckets 140 may be mounted on the rotor 120 via tangential entry and the like. Each of the buckets 140 may include a blade 150 and a dovetail 160. The dovetail 160 may be configured to mate with the conforming dovetail 130 (or vice versa) of the rotor 120. The rotor 120 and the buckets 140 may have any size, shape, or configuration. The rotor and blade assembly 310 also may include the locking blade groove 300 similar to that described above. Other components and other configurations may be used herein.

The turbine rotor and blade assembly 310 also may include a locking blade 320. The locking blade 320 may include a multi-piece configuration 330. Specifically, the locking blade 320 may include a blade 340 extending from a base 350. The locking blade 320 may lack the dovetail 160. The size, shape, and configuration of the base 350 may vary. The base 350 may include a first side partial base pilot hole 360 and a second side partial base pilot hole 370. The base 350 may be surrounded, in whole or in part, by a pair of hooks with a first side hook 380 and a second side hook 390. The first side hook 380 may include a first side partial hook pilot hole 400 that conforms to the first side partial base pilot hole 360. Likewise, the second side hook 390 may include a second side partial hook pilot hole 410 that conforms to the second side partial base pilot hole 370. The first side partial base pilot hole 360 and the first side partial hook pilot hole 400 together form a first side pilot hole 420. The second side partial base pilot hole 370 and the second side partial hook pilot hole 410 together form the second side pilot hole 430. The first side pilot hole 420 and the second side pilot hole 430 may have an inward angle 435 therein extending along the base 350. The first side pilot hole 420 and the second side pilot hole 430 may have threads and the like thereon. The first side pilot hole 420 and the second side pilot hole 430 may have any size, shape, or configuration. Other components and other configurations may be used herein.

Each of the hooks 380, 390 also may include an outwardly extending flange 440. The outwardly extending flange 440 may extend from a fillet 450 therein. The fillet 450 may conform to the size and shape of the locking blade groove 300. Moreover, each hook 380, 390 may include an alignment surface 460 as a bottom surface 465 thereof. Likewise, the alignment surface 460 may conform to the size and shape of the base 350 so as to eliminate the need for the hooks 380, 390 to contact the sidewalls of the opening so as to stay aligned.

In use, the locking blade 320 of the turbine rotor and blade assembly 310 may be inserted within the locking blade groove 300. Specifically, the hooks 380, 390 may be positioned within the locking blade groove 300. The base 350 then may be inserted between the hooks 380, 390. The base 350 may be secured therein by inserting a pair of side screws 470, 480 or other type of insert. The side screws 470, 480 may have threads and the like thereon. The rotor and blade assembly 300 thus may be secure within the rotor 120.

The locking blade 320 with the multi-piece configuration 330 thus may improve the overall fatigue life of the turbine rotor and blade assembly 310. Specifically, the use of the multi-piece configuration 330 may avoid inherent rotor stress concentrations that may be caused by the small radius of a tapped hole when using blade retention screws and the like. Rather, the multi-piece configuration 330 uses the hooks 380, 390 within the locking blade groove 300 of the rotor 120 without requiring the use of screws tapped or otherwise inserted into the rotor 120. The multi-piece configuration 330 thus may improve the fatigue life of the rotor 120 and related components for an extended component lifetime.

The use of the alignment surface 460 on the hooks 380, 390 may maintain the alignment of the hooks 380, 390 with the locking blade 300 so as to eliminate the need for the hooks 380, 390 to contact the sidewalls to stay aligned. The alignment surfaces 460 also may improve overall hook sheer stress capability. Likewise, the pilot holes 420, 430 provide a ready-to-tap hole so as to eliminate the need for drilling. The flanges 440 and the fillet 450 may conform to the locking blade groove 300 for ease of insertion. Moreover, the fillet 450 may improve wheel LCF (low cycle fatigue) life and creep life. Other components and other configurations may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A turbine rotor and blade assembly for a steam turbine, comprising:

a rotor;

a plurality of buckets positioned about the rotor; and a locking blade positioned about the rotor;

the locking blade comprising a base, a first side hook, and a second side hook, wherein the base comprises a first set of protrusions on a first side and a second set of protrusions on a second side, the first set of protrusions defining a first threaded surface, and the second set of protrusions defining a second threaded surface;

the locking blade comprising a first side pilot hole defined between the base and the first side hook, wherein the first side pilot hole is at least partially defined by a first thread extending from a top of the first threaded surface to a bottom of the first threaded surface and to a bottom of the base; and the locking blade comprising a second side pilot hole defined between the base and the second side hook, wherein the second side pilot hole is at least partially defined by a second thread extending from a top of the second threaded surface to a bottom of the second threaded surface and to the bottom of the base;

wherein the first side hook comprises a first flat side oriented in a radial direction, a second flat side parallel to the first flat side, a third flat side perpendicular to the first flat side and the second flat side, wherein a first radial edge between the first flat side and the third flat side is chamfered, and a second radial edge between the second flat side and the third flat side is chamfered.

2. The turbine rotor and blade assembly of claim 1, wherein the locking blade comprises a blade extending from the base.

3. The turbine rotor and blade assembly of claim 1, wherein the first side pilot hole comprises a first side screw therein and wherein the second side pilot hole comprises a second side screw thereon.

4. The turbine rotor and blade assembly of claim 1, wherein the base comprises a first side partial base pilot hole and a second side partial base pilot hole.

5. The turbine rotor and blade assembly of claim 4, wherein the first side hook comprises a first side partial hook pilot hole.

6. The turbine rotor and blade assembly of claim 4, wherein the second side hook comprises a second side partial hook pilot hole.

7. The turbine rotor and blade assembly of claim 1, wherein the first side pilot hole and the second side pilot hole comprise an inward angle towards the base.

8. The turbine rotor and blade assembly of claim 1, wherein the first hook and the second hook comprise a flange thereon.

9. The turbine rotor and blade assembly of claim 8, wherein the first hook and the second hook comprise a fillet positioned about the flange.

10. The turbine rotor and blade assembly of claim 8, wherein the rotor comprises a locking blade groove and wherein the flanges are sized to accommodate the locking blade groove.

11. The turbine rotor and blade assembly of claim 1, wherein the first hook and the second hook comprise a bottom surface with an alignment surface thereon.

12. The turbine rotor and blade assembly of claim 11 wherein the alignment surfaces accommodate the base.

13. The turbine rotor and blade assembly of claim 1, wherein the rotor comprises a dovetail slot and wherein the plurality of buckets comprises a dovetail for mating with the dovetail slot.

14. A method of assembling a number of buckets on a rotor, comprising:

positioning the number of buckets within a dovetail slot of the rotor;

positioning a first side locking blade hook and a second side locking blade hook within a locking blade groove of the rotor, wherein the first side locking blade hook comprises a first flat side oriented in a radial direction, a second flat side parallel to the first flat side, a third flat side perpendicular to the first flat side and the second flat side, wherein a first radial edge between the first flat side and the third flat side is chamfered, and a second radial edge between the second flat side and the third flat side is chamfered;

positioning a locking blade base between the first side locking blade hook and the second side locking blade hook; positioning a first set of protrusions on a first side of the locking blade base and a second set of protrusions on a second side of the locking blade base, the first set of protrusions defining a first threaded surface, and the second set of protrusions defining a second threaded surface;

positioning a first side screw in a first side pilot hole formed between the first side locking blade hook and the locking blade base, wherein the first side screw engages a first thread extending from a top of the first threaded surface of the locking blade base to a bottom of the first side locking blade hook and to a bottom of the locking blade base; and positioning a second side screw in a second side pilot hole formed between the second side locking blade hook and the looking blade base, wherein the second side screw engages a second thread extending from a top of the second threaded surface of the locking blade base to a bottom of the second side locking blade hook and to a bottom of the locking blade base.

15. A locking blade for use with a rotor, comprising:

a base comprising a first set of protrusions on a first side and a second set of protrusions on a second side, the first set of protrusions defining a first threaded surface, and the second set of protrusions defining a second threaded surface;

a first side hook oriented in a radial direction comprising a first flat side, a second flat side parallel to the first flat side, a third flat side perpendicular to the first flat side and the second flat side, wherein a first radial edge between the first flat side and the third flat side is chamfered, and wherein a second radial edge between the second flat side and the third flat side is chamfered;

a first side pilot hole at least partially defined between the base and the first side hook, wherein the first side pilot hole comprises a first thread extending from a top of the first threaded surface to a bottom of the first side hook and to a bottom of the base;

a second side hook;

a second side pilot hole at least partially defined between the base and the second side hook, wherein the second side pilot hole comprises a second thread extending from a top of the second threaded surface to a bottom of the second side hook and to the bottom of the base; and wherein the first side pilot hole and the second side pilot hole comprises an angle towards the base; and wherein the first threaded surface and the second threaded surface are angled with respect to a central axis of the base.

16. The locking blade of claim 15, wherein the first side pilot hole comprises a first side screw therein and wherein the second side pilot hole comprises a second side screw thereon.

17. The locking blade of claim 15, wherein the base comprises a first side partial base pilot hole and a second side partial base pilot hole.

18. The locking blade of claim 15, wherein the first side hook comprises a first side partial hook pilot hole and wherein the second side hook comprises a second side partial hook pilot hole.

19. The locking blade of claim 15, wherein the first hook and the second hook comprise a bottom surface with an alignment surface thereon so as to accommodate the base.

* * * * *